United States Patent [19]

Cecchi

[11] Patent Number: 4,643,786

[45] Date of Patent: Feb. 17, 1987

[54] PROCESS AND APPARATUS FOR APPLYING LABELS

[76] Inventor: Gianfranco Cecchi, Via A. Ressi, 34/A, 20125 Milano, Italy

[21] Appl. No.: 731,584

[22] Filed: May 7, 1985

[30] Foreign Application Priority Data

May 9, 1984 [IT] Italy ..... 20846 A/84

[51] Int. Cl.[4] ..... B65C 3/02; B65C 3/12

[52] U.S. Cl. ..... 156/187; 156/215; 156/446; 156/578; 156/DIG. 6; 156/DIG. 11; 156/DIG. 41

[58] Field of Search ..... 156/475, 187, 213, 215, 156/446, 578, DIG. 6, DIG. 11, DIG. 26, DIG. 41

[56] References Cited

U.S. PATENT DOCUMENTS 3,839,122 10/1974 Current et al. ..... 156/446

FOREIGN PATENT DOCUMENTS 484597 7/1952 Canada ..... 156/446

334636 9/1930 United Kingdom ..... 156/DIG. 41

*Primary Examiner*—Michael Wityshyn

*Attorney, Agent, or Firm*—Young & Thompson

[57] ABSTRACT

To apply automatically a label to an object, particularly a food product, of substantially cylindrical irregular shape, the object is introduced into a loop purposely formed in a conveyor belt, with one end of the label interposed between the object and the belt. The object is enveloped almost entirely with the belt inside the loop together with the label, whereupon the conveyor belt is moved causing the rotation of the object and of the label, the ends of which label are overlapped and then glued together.

10 Claims, 5 Drawing Figures

PROCESS AND APPARATUS FOR APPLYING LABELS

BACKGROUND OF THE INVENTION

The present invention concerns the application of identification labels to objects of substantially cylindrical irregular shape, particularly to food products having such a shape, such as sausage meats—especially salami, sausages, "coppa" and the like—and some cheeses.

As known, at present this operation is carried out manually, by picking the adhesive label from an automatic distributor which also dampens the same, and by applying it around the object to be identified.

As food products are involved, the label should not be glued on the object, but only on itself, at its overlapping ends. However, it should adhere to the object enough to be prevented from easily slipping of. These are the reasons why, up to now, labels have always been applied exclusively by hand. In fact, for an automatic application of the label, many difficulties have to be overcome, deriving from the typical nature of the products to be labelled, and this has so far not been accomplished. It should in fact be noted that:

the real diameter of the object to be labelled can differ even to a significant extent from the nominal one; for instance, in the case of salami, if the nominal diameter is of 40 mm, the real diameter can vary between 35 and 45 mm approximately;

the average diameter at the two ends of the object to be labelled is generally different (especially in sausage meats and cheeses, which are often of conical shape);

the cross section of the object to be labelled is seldom circular; more frequently, it is vaguely elliptical and, often, it takes up very irregular shapes;

the real length of the object to be labelled can be quite different (up to 20% more or less) from the nominal length;

the longitudinal axis of the object to be labelled is seldom rectilinear; in fact, sausage meats and cheeses usually take up a curved banana shape;

the label should be applied so as to adhere to the object to be identified and automatically adapt itself to any protuberances of said object, without forcing it to take up more regular geometrical shapes (which would harm its preservation, where—as in most cases—fresh food products are involved).

SUMMARY OF THE INVENTION

Taking into account all the above problems, the present invention now provides for a fully satisfactory process and apparatus for the automatic application of labels to objects of substantially cylindrical irregular shape, according to which said objects are enveloped by a flexible member, adjusting itself to the surface thereof, and are caused to rotate by moving said flexible member in order to apply the labels thereon.

More precisely, the invention relates to a process for automatically applying an identification label to an object, particularly to a food product, of substantially cylindrical irregular shape, consisting in introducing said object into a loop purposely formed in a conveyor belt, with one end of the label interposed between said object and said belt, in enveloping almost entirely said object with said belt inside said loop, and in causing the rotation of said object by moving said belt, so as to wrap the label round it and overlap the label ends for reciprocal gluing thereof.

The invention also concerns an apparatus to carry out said process, characterized in that it comprises, within a suitable framework: a conveyor belt, adapted to form a loop between a pair of idle rollers around which it winds; a container for the objects which have to be labelled; means for automatically feeding said objects into said loop of the conveyor belt; a container for the labels and a device for feeding the same into said loop, close to said pair of rollers; drive means for moving the conveyor belt and devices for stopping the movements thereof, respectively in one direction and in both directions, in order to form said loop and vary the width thereof.

Preferably, the loop in the conveyor belt is formed between two belt guide and support rollers, one of which is fixed and the other is movable towards and away from the first, the movable roller being mounted, together with other idle rollers for guiding and supporting the belt, on an arched support oscillating about a pin coaxial to one of said other rollers.

BRIEF DESCRIPTION OF THE DRAWINGS

The invention is now described in further detail, by mere way of example, with reference to the accompanying drawings, which represent a preferred practical embodiment thereof, and in which.

DESCRIPTION OF THE PREFERRED EMBODIMENT

Figure 1:
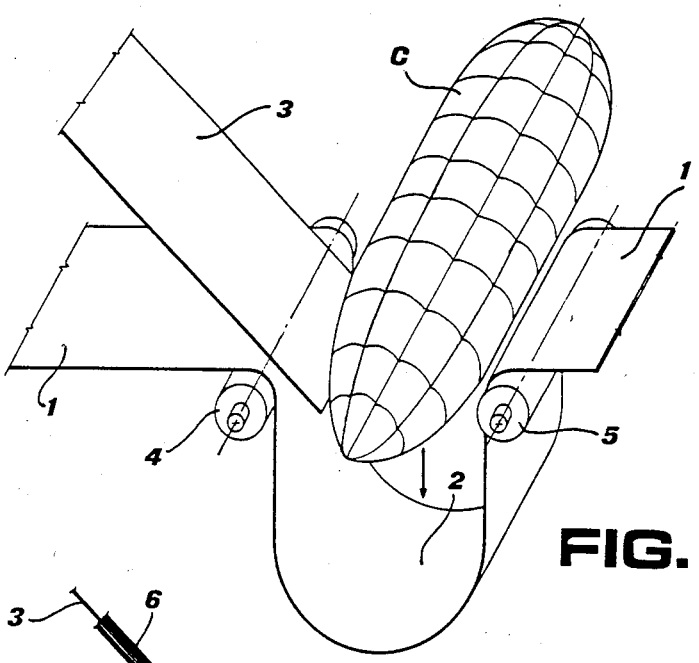
FIGS. 1 to 3 show diagrammatically the concept of applying labels, on which the present invention is based, illustrating three different stages of the process.
Figure 2:
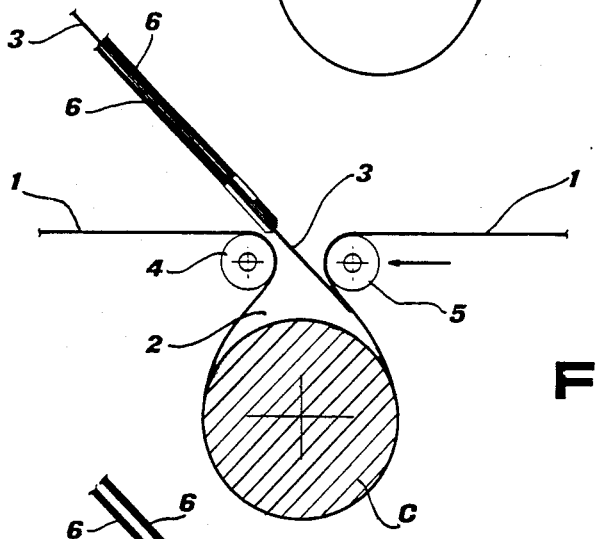
Figure 3:
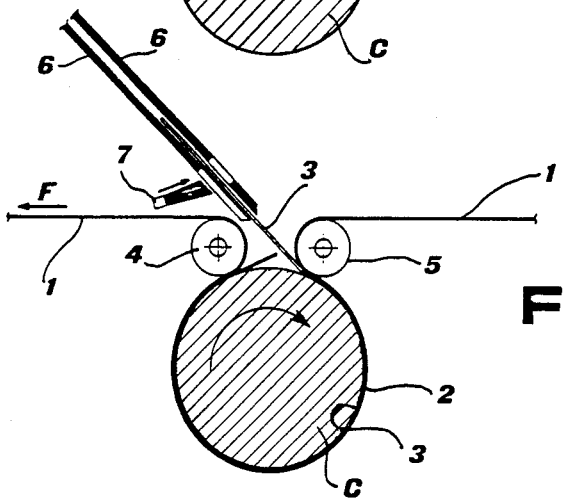

As shown in FIGS. 1 to 3, an object C of substantially cylindrical irregular shape—consisting for instance of a salami (FIG. 1)—is fed into a loop 2 formed, to house the same, by a conveyor belt 1, a label 3 being simultaneously fed into said loop. The conveyor belt 1 passes over two idle rollers 4 and 5, the first of which is fixed, while the second is movable horizontally to draw close to or more away from the first roller.

When the object C is arranged inside the loop 2 of the conveyor belt 1, the movable idle roller 5 is drawn close to the fixed idle roller 4, so as to envelop the object C and prevent its escape, as shown in FIG. 2.

It should be noted that the roller 5 draws close to the roller 4, leaving enough space to allow the passage of the label 3 which is moved forward between the guides 6.

The conveyor belt 1, which has so far been kept motionless, is now moved by applying a pulling action in the direction of the arrow F on the left side of the drawing (FIG. 3), while the opposite side of the belt remains motionless. The belt thereby envelops more tightly the object C, adapting itself both to the diameter and to the shape thereof and locking also the label 3 between the belt 1 and the object C, at the idle roller 5. During this stage, the right side of the conveyor belt 1 remains motionless until the whole belt length exceeding the circumference of the object C has been recovered.

At this point, by continuing to pull the belt 1 on the left side, in the direction F, also the right side of said belt is caused to move, thereby causing the rotation of the object C while the label 3 winds round it sliding between the guides 6, as shown in FIG. 3.

As the idle rollers 4 and 5 are drawn quite close, the overlapping of the two ends of the label 3 occurs automatically, as appears evident from the kinematics of the system.

By wetting the end of the label with the brush 7 (FIG. 3), before it overlaps the other end, the label itself will glue together and its application will be most efficiently obtained. The final step is to release the object C from the belt conveyor 1, by moving the roller 5 away from the roller 4.

Figure 4:
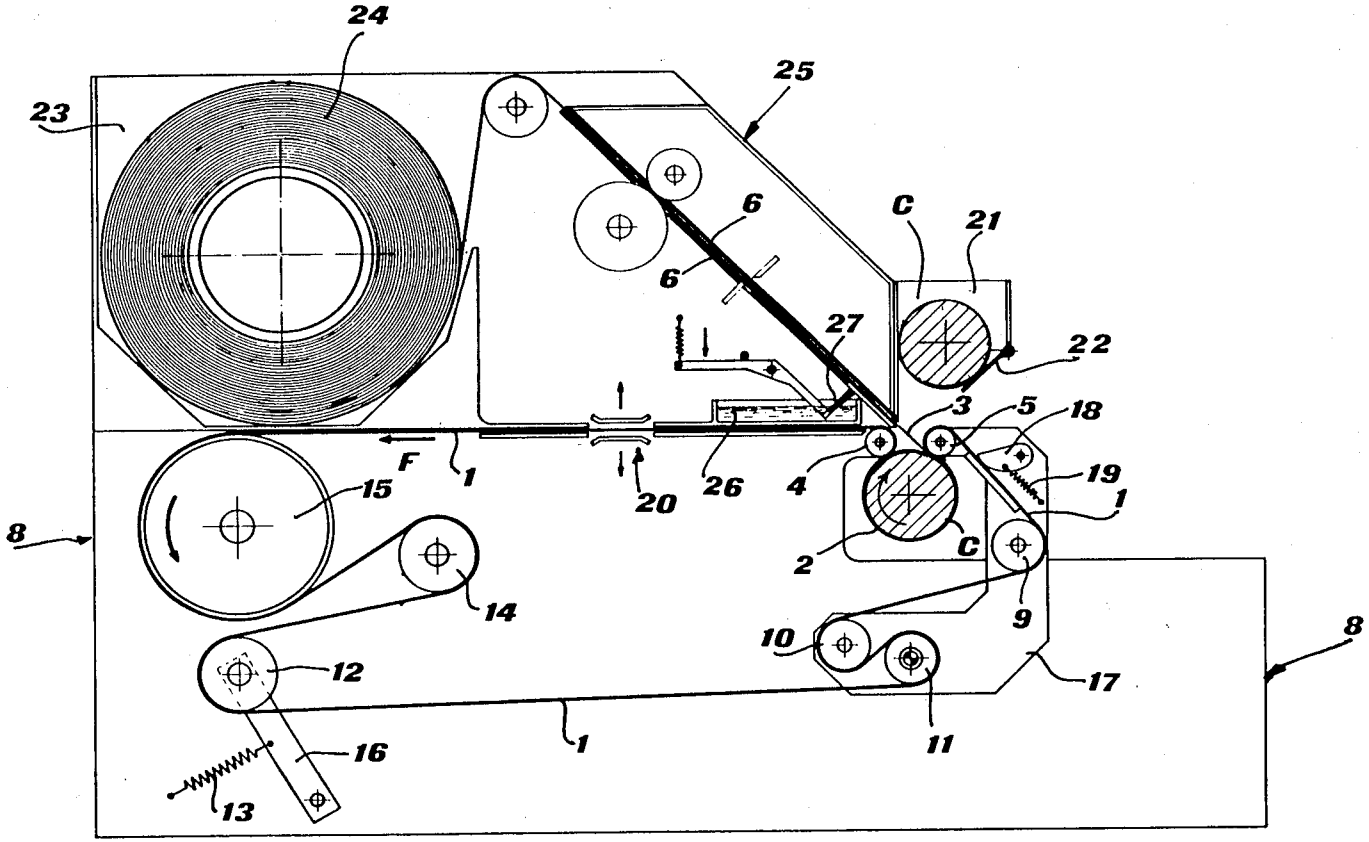
FIGS. 4 and 5 show the diagram of an apparatus for applying labels, according to the invention, in two successive working stages.
Figure 5:
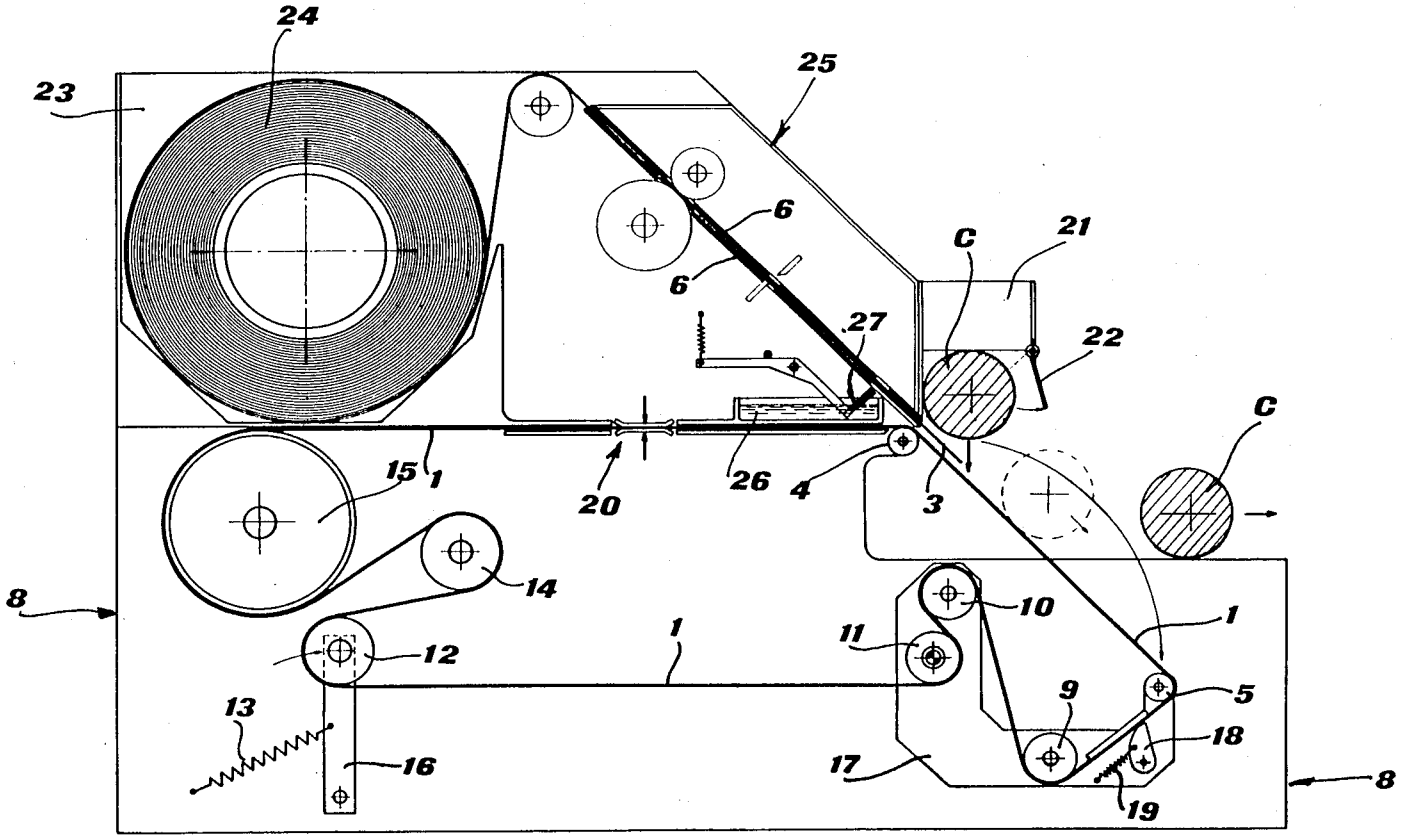

With reference to FIGS. 4 and 5, a description is now given—by mere way of example—of an apparatus adopting the aforespecified general arrangement, for efficiently carrying out the present invention.

The said apparatus comprises, within a framework 8, a conveyor belt 1 which circulates and forms a loop 2, for housing an object C to be labelled, between a fixed roller 4 and a movable roller 5, both idle; said conveyor belt 1 also passes about idle rollers 9, 10 and 11, round an idle tension roller 12 oscillating under the control of a spring 13, round a fixed idle roller 14, and round a fixed drive roller 15 which controls the movements of said belt. The fixed idle rollers 4 and 14 and the drive roller 15 are mounted directly on the framework 8, on which is also mounted the roller 12 by way of its own oscillating arm 16, while the rollers 5, 9, 10 and 11 are mounted on an arched support 17 oscillating about a pin coaxial with the roller 11.

On the same support 17 is mounted a friction ratchet 18 with tension spring 19 (or other similar locking device), allowing the conveyor belt 1 to freely slide only in the direction of the arrow F, while stopping the movements thereof in the opposite direction.

A presser 20 is moreover mounted in the framework 8, positioned along the horizontal stretch covered by the conveyor belt 1 between the rollers 4 and 5, and allowing to stop the movements of said belt 1 in both directions.

The top part of the framework 8 houses furthermore a container 21 with trap door 22 (in which is arranged the object C, retained by the trap door, while waiting for the label to be applied), a container 23 for a roll 24 of adhesive labels, and a conventional device 25 for picking a label 3, cutting it to size and placing it, at the right moment, just inside the loop 2 formed between the rollers 4 and 5, with its end close to the idle roller 5.

The device 25 also comprises a small basis 26 filled with water, and automatically controlled brushes 27 to wet the labels 3.

The automatic-cycle operation of the heretofore described apparatus takes place as follows.

In the condition illustrated in FIG. 4, the pulling action on the conveyor belt 1, imparted by the drive roller 15 in the direction of the arrow F, has already caused said belt to adhere to the object C (for instance a salami) and the label 3 to be clamped between said object and the belt 1, in correspondence of the idle roller 5, substantially according to the general scheme of FIG. 3. This is obtained thanks to the intentional presence of friction in the apparatus, which, while allowing the belt portion to the left of the roller 5 to move, prevents motion of the belt portion to the right of said roller, until the object C is tightly enveloped by the belt 1.

At this stage, the tension roller 12 recovers the difference in belt length between the extension of the loop 2, housing the object C, and the circumference of the object itself, while the rollers 5, 10 and 11 remain motionless.

From this moment, as the drive roller 15 continues to rotate, said friction is overcome and all the portions of the belt 1 move at the same speed. The object C is thus caused to rotate, drawing the label 3 therewith.

A synchronized mechanism (not shown) drives the brushes 27, partially soaked in the water of the basin 26, against the lower adhesive side of the label 3, so as to wet the glue of its rear end only, which will overlap the front end.

Once the overlapping has taken place, the drive roller 15 stops and, after a certain time—usually very short—to allow the glue to set, the loop 2 opens. The opening of the loop takes place (FIG. 5) by drawing the movable idle roller 5 away from the fixed idle roller 4, thanks to the rotation of the arched support 17 to which the idle roller 5 is fixed. This characteristic allows the automatic discharge of the object, already provided with the label, due to gravity and to the inclination of the conveyor belt 1 with the loop 2 in the open condition.

While the arched support 17 rotates clockwise, causing the opening of the loop 2 and the discharge of the object C, the drive roller 15 is motionless. Since the rotation angle of the arched support 17 is such that the distance between the idle rollers 4 and 5 (open loop) is greater than the widest circumference of the objects onto which the label has to be applied, in the final part of the rotation of said support 17 there is a belt recovery—allowed by the ratchet 18—with a consequent clockwise motion of the idle tension roller 12.

Once it has reached a lower stop (not shown), the arched support 17 starts its closing backstroke.

Just as the closing starts, the device 25 is operated, with the cutting to size and the positioning of a new label 3, while the opening of the trap door 22 is effected shortly afterwards, to drop from the container 21 into the loop 2 being formed a new object C to be labelled. During this stage in which the loop is formed, the presser 20 starts to work automatically, preventing—together with the ratchet 18—any movements of the belt 1, so as to allow the forming of said loop, which takes place with no belt recovery by the tension roller 12.

The opening of the trap door 22 is synchronized with the rotation of the arched support 17, so as to prevent the object C, dropped from the container 21, from leaving the loop 2 being formed and to allow instead said object to contribute, by its own weight, to the proper forming of said loop, by pulling downward the belt portion forming the loop itself.

At the end of the rotation, the arched support 17 has returned to the position of FIG. 4, the pressor 20 locking the belt 1 opens, the trap door 22 closes again, and the drive roller 15 starts to pull the belt in the direction F, restarting the already described cycle, while a new object C is introduced into the container 21.

It is to be understood that the previous description of the invention is in no way restrictive.

The invention may in fact be carried out in many other ways, differing from those heretofore described. In particular, the apparatus may be realized with modifications or variants which will appear at once evident to the skilled in the art, without thereby departing from the scope of the invention itself.

In this respect, it seems appropriate to expressly point out that the movement of the idle roller 5 is not essential for the working of the system, in that the object C could instead be introduced into the loop 2 along its own longitudinal axis (substantially coinciding with that of the loop), with the idle rollers 4 and 5 always in a close position. The movement of the roller 5 provides a simpler and more rational automatic system for the introduction and discharge of the object C and for the forming of the loop 2.

It is also not essential for the idle roller 4 to be fixed, but obviously both rollers 4 and 5 could be movable for the opening and closing of the loop.

It is neither essential for the flexible element forming the loop to consist of a single belt; for instance, a set of side by side belts of suitable section could provide an equally valid solution.

Concerning the label 3, instead of being positioned—as previously said—prior to the closing of the loop 2, it could be inserted into said loop slightly later, when the object C has already been enveloped by the belt 1 and is rotating. Also in this case, in fact, the label 3 would be caught and drawn to envelope the object C.

Practical tests have proved that the heretofore described and illustrated system is adapted to rotate, and thus efficiently apply identification labels on salami and like products having the oddest cross sections, provided that there are no large sharp edge protuberances and provided that the largest transversal dimension of said products is not more than twice the smallest dimension.

The use of the most common adhesive labels has been described, but one could equally well make use of labels having a self-adhesive end, or of non-adhesive labels, as long as a system adopting a suitable bonding agent were provided in replacement of the wetting system.

What is claimed is:

1. Process for automatically applying an identification label to objects of substantially cylindrical irregular shape, comprising forming an empty open loop in a conveyor belt, said loop being substantially larger than a said object to be labeled; introducing a said object into said loop, introducing only one end of a label into the loop; enveloping almost entirely said object with said belt, reducing the size of the loop; and causing the rotation of said object by moving said belt lengthwise, so as to wrap the label round the object and to overlap the label ends for the mutual securement thereof.

2. A process as in claim 1, in which said object is introduced into said loop by dropping the object into the loop from above.

3. A process as in claim 1, in which said object is introduced into said loop from a side of said loop.

4. Apparatus for automatically applying an identification label to objects of substantially cylindrical irregular shape, comprising a conveyor belt, means for forming an empty open loop in the belt of a size substantially larger than the object to be labeled, means for introducing into the loop a said object to be labeled, means for introducing into the loop only one end of a label to be applied to the object, means for enveloping almost entirely said object with said belt, and means for reducing the size of the loop and for causing rotation of said object by moving said belt lengthwise so as to wrap the label around the object and to overlap the label ends for the mutual securement thereof.

5. Apparatus as in claim 4, said means for introducing said object into said loop comprising means for dropping the object into the loop by gravity from above.

6. Apparatus as in claim 4, and means for moistening only one end of said label.

7. Apparatus as in claim 4, said loop-forming means comprising a roller that rotates about a fixed first axis and a movable roller, means mounting said movable roller for swinging movement toward and away from said fixed roller about a second axis, said mounting means also supporting a plurality of idle rollers about which said conveyor belt is trained.

8. Apparatus as in claim 7, one of said idle rollers rotating about said second axis.

9. Apparatus as in claim 4, and ratchet means permitting circulation of said conveyor belt in only one direction.

10. Apparatus as in claim 4, and presser means selectively engageable with said conveyor belt to prevent movement of said conveyor belt in either direction.

* * * * *